US005777430A

United States Patent [19]

Ueda et al.

[11] Patent Number: 5,777,430

[45] Date of Patent: Jul. 7, 1998

[54] FUNNEL FOR A CATHODE RAY TUBE HAVING A FLARE ZONE

[75] Inventors: Yuichi Ueda; Shinie Inamura; Yukio Morisawa, all of Funabashi, Japan

[73] Assignee: Asahi Glass Company Ltd., Tokyo, Japan

[21] Appl. No.: 721,377

[22] Filed: Sep. 26, 1996

[30] Foreign Application Priority Data

May 9, 1996 [JP] Japan ..... 8-115073

[51] Int. Cl.[6] ..... H01J 31/00

[52] U.S. Cl. ..... 313/477 R; 313/318.01; 313/477.11

[58] Field of Search ..... 313/477 R, 479, 313/480, 482, 477 HC, 318.01, 318.05

[56] References Cited

U.S. PATENT DOCUMENTS 4,403,170 9/1983 Misono et al. ..... 313/479

5,510,670 4/1996 Osborne et al. ..... 313/479

*Primary Examiner*—George M. Dombroske

*Assistant Examiner*—Max H. Noori

*Attorney, Agent, or Firm*—Oblon, Spivak, McClelland, Maier & Neustadt, P.C.

[57] ABSTRACT

A funnel for a cathode ray tube, which includes a neck tube; the neck tube having an end enlarged to provide a flare zone; and the flare zone having an opened end for coupling a stem for supporting stem pins thereto; wherein the flare zone has at least an outer shape constituted by a tapered surface and a substantially straight surface continuous therewith.

7 Claims, 3 Drawing Sheets

FUNNEL FOR A CATHODE RAY TUBE HAVING A FLARE ZONE

BACKGROUND OF THE INVENTION

1. Field of the Invention

The present invention relates to a funnel for a cathode ray tube, in particular the shape of a neck tube of the funnel.

2. Discussion of Background

A cathode ray tube and a Braun tube are each a main component of a TV receiver. In FIG. 6, there is shown the basic structure of a cathode ray tube for TV receivers. The present invention is applicable to such a cathode ray tube.

The cathode ray tube 1 comprises a panel glass 2 at a front and a funnel at a rear which are in a hermetically sealed. On use of the cathode ray tube, a glass bulb in the form of an envelop is constituted by the panel glass 2 and the funnel has an inner chamber are maintained at high vacuum as much as about $10^{-7}$–$10^{-6}$ Torr.

The funnel is constituted by a funnel-shaped funnel glass body 3 and a cylindrical neck tube 4. The neck tube 4 has three of electro-static convergence type electronic guns 5 housed therein. What the electronic guns 5 carry out is not only that thermions which have been emitted from three cathodes heated at 900°–1,000° C. by heaters are accelerated and converged into respective beams by a grid, and are emitted as respective electron beams 6, and but also that the power of the respective electron beams is controlled depending on the magnitude of an image signal to make brightness modulation.

The panel glass 2 has an inner surface formed with a screen 7 which consists of the fluorescent materials corresponding to an image display area. A shadow mask 8 is arranged a minute distance from the screen 7 to work as color discrimination means, which has a shape similar to the shape of the inner surface of the panel glass. The electron beams 6 are accelerated by a voltage which has been applied between the respective cathode and corresponding anodes and is as high as 25–32 kV. A predetermined dot on the screen 7 is selected by the shadow mask 8, and an electron beam hits against the selected dot to make it emit light. As luminescent materials for dots on the screen, three colors, i.e. red, green and blue luminescent fluorescent materials are used, and a combination among the three colors of fluorescent materials gives a desired luminescent color. In order to obtain such a desired luminescent color, a single fluorescent material is painted for each dot, and a group of three dots forms a picture element on the fluorescent screen. The fluorescent material of each dot is excited by an accelerated electron to emit light when an electron beam 6 hits against the fluorescent material.

With regard to a pictorial image, a magnetic field which is produced by deflection yoke coils 10 mounted around a yoke area 9 corresponding to the collar of the funnel glass body 3 bends the electron beams 6 in predetermined directions to irradiate luminescent points, thereby forming an image.

The yoke area 9 of the funnel glass body 3 is shaped to have a portion at the side of the panel glass 2 enlarged and a portion at the side of the neck tube 4 reduced, providing a funnel-like configuration as a whole.

The deflection yoke coils 10 have an inner surface formed in a funnel-like shape similar to the yoke area 9. The deflection yoke coils are put on the yoke area 9 of the funnel glass body 3 from the side of the neck tube 4 to be mounted on the yoke area 9 after the main parts of the cathode ray tube 1 have been assembled. This means that the inner diameter of the deflection yoke coils 10 at the side of the neck tube 4 is required to be larger than the outer diameter of the neck tube 4.

An increase in the inner diameter of the deflection yoke coils 10 makes the distance from the electron beams 6 in the neck tube 4 longer, and more power which complies with the longer distance is required to deflect the electron beams 6, which is not preferable. From this viewpoint, the inner diameter of the deflection yoke coils 10 is required to be restrained to such a degree that the inner diameter is slightly larger than the outer diameter of the yoke area 9, considering dimensional accuracy of the yoke area 9 of the funnel glass body 3 and a position adjusting amount of the deflection yoke coils 10. A decrease in the outer diameter of the yoke area 9 of the funnel glass body 3 is also required to lower the power needed to deflect the electron beams 6, necessarily leading to a decrease in the outer diameter of the neck tube 4.

The neck tube 4 has a leading end jointed to a stem (stem glass) 11, which supports about 10–16 of stem pins 12 in order to electrically connect an external circuit with the heaters and the electrodes in the electronic guns 5. The size of the stem 11 for supporting the stem pins is required to have a predetermined outer diameter because of need for constant pin intervals.

There have recently been demands for controlling the convergence of the electron beams with high accuracy in the cathode ray tube which is provided with such electrostatic convergence type of electronic guns. In order to meet the demands, multistage electron beam convergence electrodes are required to be provided in the electronic guns, accompanied by an increase in the number of the stem pins for electrically connecting the multistage electron beam convergence electrodes and the external circuit. In that case, taking into account insulation of the respective stem pins, prevention of crosstalk and with consideration of operating performance, the intervals between the stem pins are needed to be a predetermined required distance, necessitating a greater stem for supporting the stem pins.

If the convergence of the electron beams is controlled with high accuracy using the conventional cathode ray tube without modification, the outer diameter of the neck tube of the funnel is forced to be enlarged, accompanied by an increase in size of the inner diameter of the deflection yoke coils, which inconveniently requires greater deflection power.

It has been proposed that the size of the outer diameter of the neck tube is maintained the same as one without an increase in the number of the stem pins, the neck tube has an end enlarged to form a flare zone, wherein a stem for supporting many stem pins including increased stem pins is coupled to an opened end of the flare zone. In FIG. 5, there is shown a schematic cross sectional view showing a funnel of a cathode ray tube wherein one end of the neck tube is formed as the flare zone. The flare zone 13 of the neck tube 4 has both inner and outer surfaces formed by conical tapered surfaces, making the outer diameter of the stem 11 extremely large. Under such arrangement, if the deflection yoke coils are put on the yoke area from the side of the neck tube 4 to be mounted on the yoke area of the funnel glass body as usual, it is necessary to enlarge the size of the inner diameter of the deflection yoke coils like the case wherein the outer diameter of the neck tube 4 is enlarged as stated earlier, or to divide the deflection yoke coils into two parts and couple the two parts when the deflection yoke coils are mounted on the yoke area of the funnel glass body.

The former case is not preferable because greater deflection power is required as stated earlier. The latter case is not preferable either because of increased cost because new shape of deflection yoke coils are required to be manufactured.

SUMMARY OF THE INVENTION

It is an object of the present invention to provide a funnel for a cathode ray tube which can control the convergence of electron beams with high accuracy without a significant increase in power used in deflection yoke coils, considering the problems stated above.

The present invention provides a funnel for a cathode ray tube, comprising a neck tube, the neck tube having an end enlarged to provide a flare zone, and the flare zone having an opened end for coupling a stem supporting stem pins thereto, wherein the flare zone has at least an outer shape constituted by a gradually-enlarged (i.e. tapered) surface or portion and a nongradually-enlarged (i.e. substantially straight) surface or portion continuous therewith.

In the present invention, the nongradually-enlarged surface or portion means that the diameter of the flare zone does not linearly increase in the axial direction of the neck tube unlike the conventional one, that the diameter is constant or almost constant, and that even if the diameter increases, the diameter gently increases. The nongradually-enlarged surface or portion is not limited to a cylindrical surface or portion having a constant diameter.

In accordance with the present invention, it is possible to control the convergence of the electron beams with high accuracy. Even if the number of the stem pins supported by the stem for supporting stem pins is increased, it is possible to put deflection yoke coils on a neck tube to mount on a yoke area of the funnel by slightly increasing the size of the inner diameter of the deflection coils than that of the nongradually-enlarged surface as the outer surface of the flare zone of the neck tube while maintaining the size of the outer diameter of the neck tube at the same as that of the outer diameter of one wherein the number of the stem pins is not increased, as usual. This is because the stem for supporting stem pins is joined to an opened end of the flare zone of the neck tube which has the outer surface formed in the nongradually-enlarged surface.

According to the present invention, it is possible to make the size of the inner diameter of the deflection yoke coils smaller in comparison with a case wherein the flare zone of the neck tube has the entire outer surface formed in a gradually-enlarged surface. It is possible to decrease power used for deflecting the electron beams by an amount corresponding to reduction in the size of the inner diameter. In addition, deflection yoke coils having a conventional shape can be used, and there is no need for forming the deflection yoke coils in a special shape such as a two-part shape.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

In a preferred mode of the present invention, an outer shape of a flare zone of a funnel for a cathode ray tube has a gradually-enlarged surface and a nongradually-enlarged surface constituted by a conical surface and a cylindrical surface, respectively.

In another preferred mode, the gradually-enlarged surface and the nongradually-enlarged surface of the outer shape of the flare zone are constituted by a cup-like curved surface.

In another preferred mode of the present invention, the inner shape of the flare zone of the funnel is formed so as to be substantially the same as the outer shape of the flare zone. In other words, in one mode the outer and inner shapes of the flare zone are formed to have gradually-enlarged surfaces of conical surfaces and nongradually-enlarged surfaces of cylindrical surfaces. In another mode, both inner and outer surfaces of the flare zone are formed to have the gradually-enlarged surfaces and the nongradually-enlarged surfaces constituted by cup-like curved surfaces, respectively.

In a further mode, the flare zone has the inner surface formed in a linear tapered surface.

According to the structure of the flare zone of the respective modes, it is not only possible to make the size of the inner diameter of deflection yoke coils smaller and decrease power required for deflection of electron beams in comparison with a case wherein the entire surface of the flare zone of a neck tube is constituted by a gradually-enlarged surface, but it is also possible to offer an advantage in that there is no need for forming the deflection yoke coils in a special shape such as a two-part shape.

The envelop of a cathode ray tube for a TV receiver is constituted by a front panel glass and a rear funnel as stated earlier, and the funnel is in turn constituted by a funnel-shaped funnel glass body and a cylindrical neck tube.

Figure 1:
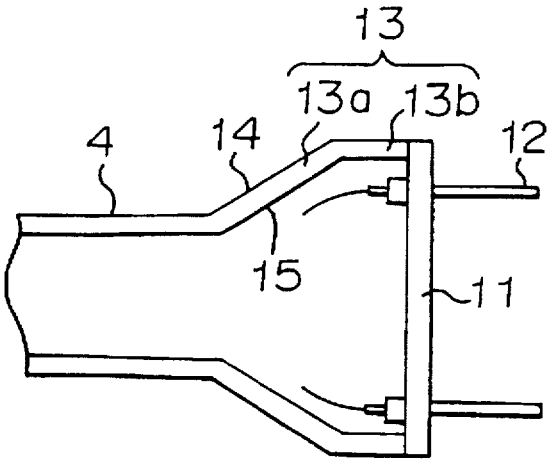
FIG. 1 is a cross-sectional view showing a part of a neck tube according to an embodiment of the present invention.

In FIG. 1, there is shown a cross-sectional view showing a part of a neck tube of a funnel for a cathode ray tube according to an embodiment of the present invention. The neck tube 4 has an opened end formed as a gradually-enlarged flare zone 13 to improve convergence accuracy of electron beams. The flare zone 13 has an outer surface 14 constituted by a conical gradually-enlarged surfaces **13*a* and a cylindrical nongradually-enlarged surface 13*b* continuous therewith. To the opened end at the nongradually-enlarged surface 13*b* is fixed a glass stem (stem glass) 11 for supporting stem pins. The stem glass 11 has a circumferential portion formed with stem pins 12** with suitable intervals, which are determined considering insulation therebetween and operating performance.

In the example shown, an inner surface 15 of the flare zone 13 is formed so as to be constituted by a conical tapered surface and a cylindrical surface like the outer surface of the flare zone. It is preferable that the conical gradually-enlarged surface **13*a* of the neck tube 4 have an expansion angle of 150° or less. It is preferable that the cylindrical nongradually-enlarged surface 13*b* has a length of about 5 mm though the length is not limited to such value. When the expansion angle is more than 15°, the outer diameter of the nongradually-enlarged surface 13*b*** inconveniently becomes too great.

Figure 2:
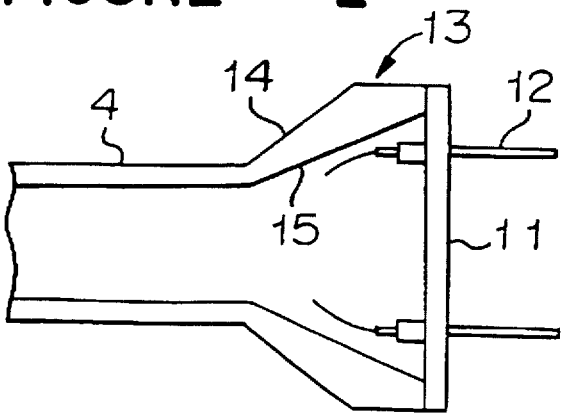
FIG. 2 is a cross-sectional view of the part in a modified embodiment of FIG. 1.

In FIG. 2, there is shown a cross-sectional view showing another example of the neck tube portion of a funnel for a cathode ray tube according to the present invention. In this example, the flare zone 13 of the neck tube 4 has the outer surface 14 formed in the same shape as the one shown in FIG. 1, and the inner surface 15 is formed to be constituted by a linear tapered surface as a conical gradually-enlarged surface.

Figure 3:
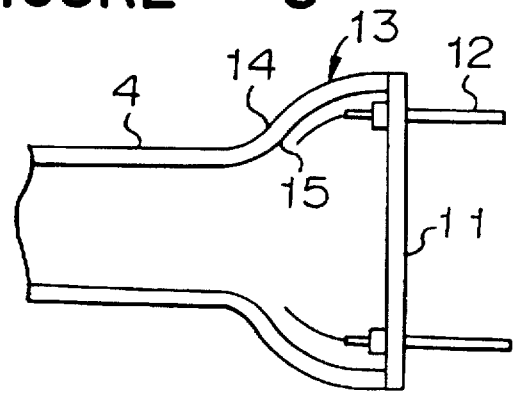
FIG. 3 is a cross-sectional showing a part of a neck tube according to another embodiment of the present invention.

In FIG. 3, there is shown a cross-sectional view showing another example of the neck tube portion of a funnel for a cathode ray tube according to the present invention. In this example, the flare zone 13 of the neck tube 4 has the gradually-enlarged surfaces and the nongradually-enlarged surfaces of the inner surface 14 and the outer surface 15 constituted by cup-shaped curved surfaces, respectively.

Figure 4:
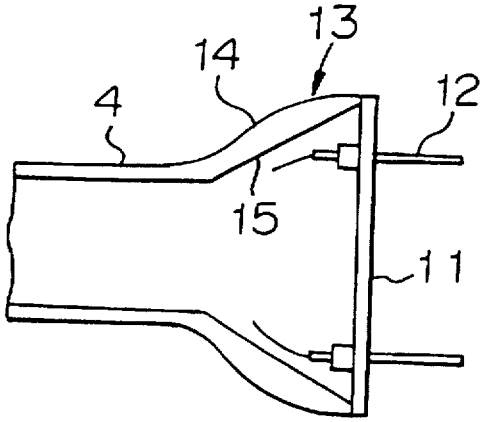
FIG. 4 is a cross-sectional view showing the part in a modified embodiment of FIG. 3.

In FIG. 4, there is shown a cross-sectional view showing a modified example of FIG. 3. In this modified example, the outer surface 14 of the flare zone 13 of the neck tube 4 is formed in the same as the one shown in FIG. 3, and the inner surface 15 is formed so as to be constituted by only a linear tapered surface as a conical gradually-enlarged surface.

Figure 5:
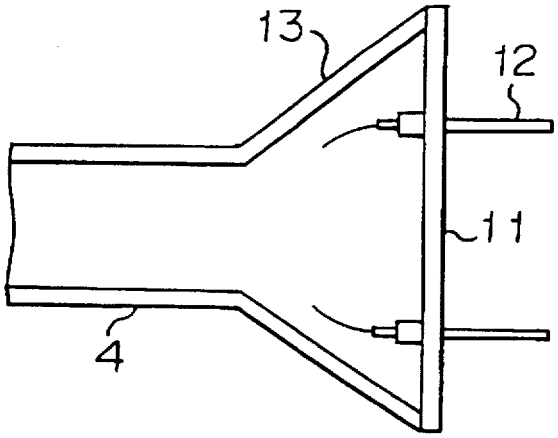
FIGURE 5 PRIOR ART
FIG. 5 is a cross-sectional view showing a part of a conventional neck tube.
Figure 6:
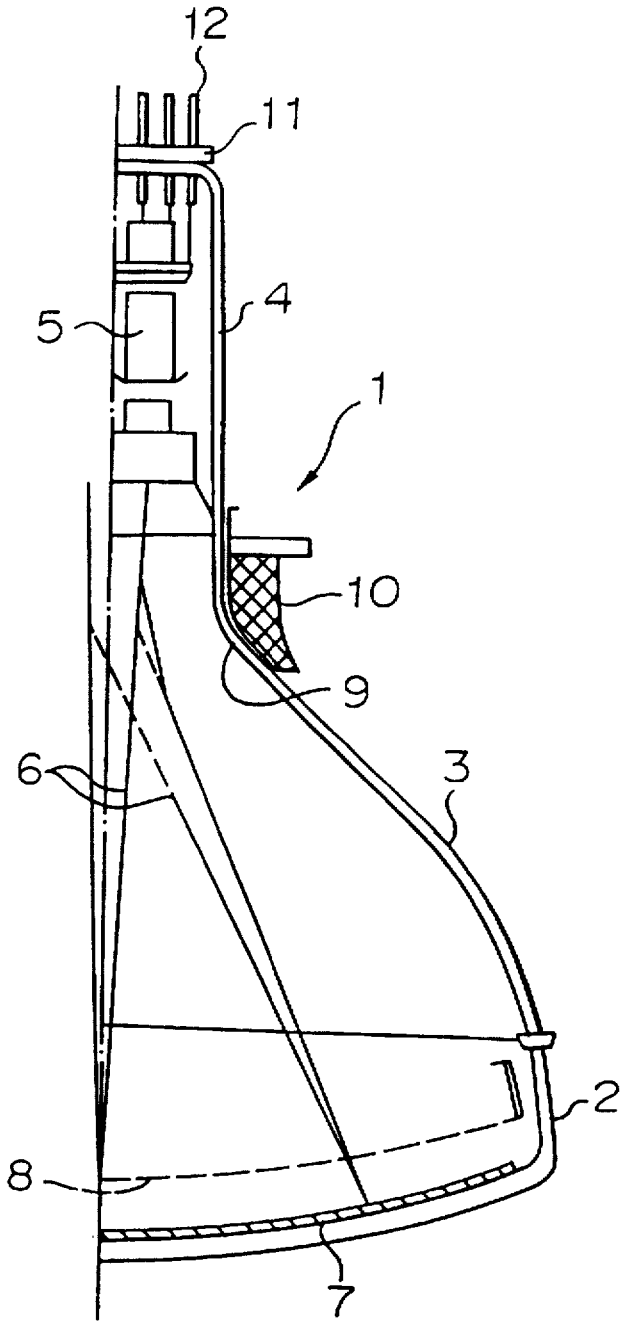
FIGURE 6 PRIOR ART
FIG. 6 is a cross-sectional view of a part of the basic structure of a conventional cathode ray tube.

According to the funnel of the embodiments shown in FIGS. 1–4 explained above, it is possible to reduce the size of the inner diameter of deflection yoke coils 10 which are put onto the flare zone 13 from outside and are mounted on a yoke area of the funnel in comparison with the conventional one (FIG. 5) wherein the entire outer surface of the flare zone 13 is formed with a gradually-enlarged surface. This is because the nongradually-enlarged surface is formed on the outer surface of the flare zone 13 of the neck tube 4 so as to be continuous with the gradually-enlarged surface in the embodiments. As a result, the distance between the deflection yoke coils 10 and the electron beams in the neck tube 4 and the funnel glass body 3 is not increased.

In accordance with the present invention, it is possible to maintain the outer diameter of the neck tube at the same size as the outer diameter of a neck tube wherein the number of the stem pins does not increase even if the number of the step pins increases in order to improve convergence accuracy of the electron beams. Even if the opened end of the neck tube is expanded to form the flare zone in order to increase the number of the stem pins, it is possible to make the size of the inner diameter of the deflection yoke coils smaller and to reduce power used for deflection of the electron beams in comparison with a flare zone with the entire surface constituted by a gradually enlarged surface. This is because the nongradually-enlarged surface is formed on the outer surface of the flare zone so as to be continuous with the gradually-enlarged surface.

In addition, it is possible to use deflection yoke coils having the conventional shape for putting the deflection yoke coils onto the neck tube because it is not necessary to increase the size of the inner diameter of the deflection yoke coils. It is also possible to reduce cost because there is no need for using deflection yoke coils having a special shape such as a two-part shape.

Obviously, numerous modifications and variations of the present invention are possible in the light of the above teachings. It is therefore to be understood that within the scope of the appended claims, the invention may be practiced otherwise than as specifically described herein.

What is claimed is:

1. A funnel for a cathode ray tube, comprising:

a neck tube;

the neck tube having an end enlarged to provide a flare zone; and the flare zone having an opened end coupling a stem supporting stem pins thereto;

wherein the flare zone has an outer shape comprising one of a tapered outer surface and a cup shaped outer surface connected to a substantially straight outer surface continuous therewith.

2. A funnel according to claim 1, wherein the tapered surface of the flare zone comprises a conical surface, and the substantially straight surface comprises a cylindrical surface.

3. A funnel according to claim 2, wherein the flare zone has an inner surface substantially parallel to an outer surface thereof, and the inner surface comprises a conical surface and a cylindrical surface connected to said conical surface.

4. A funnel according to claim 1, wherein an inner surface of the flare zone comprises a conical surface.

5. A funnel for a cathode ray tube, comprising:

a neck tube;

the neck tube having an end enlarged to provide a flare zone; and the flare zone having an opened end coupling a stem supporting stem pins thereto wherein the outer surface of the flare zone is cup-shaped.

6. A funnel according to claim 5, wherein the flare zone has an inner surface substantially parallel to said outer surface thereof, and the inner surface has a cup-like shape.

7. A funnel according to claim 1, wherein the outer surface is cup-shaped, and the inner surface is conically shaped.

* * * * *